US012319470B2

(12) United States Patent
Reinhart et al.

(10) Patent No.: US 12,319,470 B2
(45) Date of Patent: Jun. 3, 2025

(54) STACKABLE CRATE

(71) Applicant: CREATIVE PLASTIC CONCEPTS, LLC, Sycamore, OH (US)

(72) Inventors: Nickolas Reinhart, Sarasota, FL (US); Jacob H. Whitta, Bluffton, OH (US)

(73) Assignee: CREATIVE PLASTIC CONCEPTS, LLC, Sycamore, OH (US)

( * ) Notice: Subject to any disclaimer, the term of this patent is extended or adjusted under 35 U.S.C. 154(b) by 0 days.

(21) Appl. No.: 17/748,271

(22) Filed: May 19, 2022

(65) Prior Publication Data

US 2022/0371777 A1 Nov. 24, 2022

Related U.S. Application Data

(60) Provisional application No. 63/190,263, filed on May 19, 2021.

(51) Int. Cl.

| | |
|---|---|
| ***B65D 21/04*** | (2006.01) |
| ***B65D 1/38*** | (2006.01) |
| ***B65D 21/02*** | (2006.01) |

(52) U.S. Cl.

CPC ..... *B65D 21/046* (2013.01); *B65D 1/38* (2013.01); *B65D 21/0216* (2013.01); *B65D 21/0233* (2013.01)

(58) Field of Classification Search

CPC .... B65D 21/046; B65D 1/38; B65D 21/0216; B65D 21/0233

See application file for complete search history.

(56) References Cited

U.S. PATENT DOCUMENTS

| | | | | |
|---|---|---|---|---|
| 4,432,161 | A * | 2/1984 | de Bruin | B65D 85/505 47/41.01 |
| D292,634 | S * | 11/1987 | Chabot | D3/307 |
| D801,686 | S | 11/2017 | Park | |
| 2003/0024845 | A1* | 2/2003 | Smyers | B65D 21/0213 206/509 |
| 2006/0231449 | A1* | 10/2006 | Hassell | B65D 21/062 206/506 |
| 2014/0083896 | A1 | 3/2014 | Park | |
| 2017/0137175 | A1 | 5/2017 | Park | |

FOREIGN PATENT DOCUMENTS

| | | | |
|---|---|---|---|
| DE | 1174249 | * 12/1959 | B65D 21/046 |

* cited by examiner

*Primary Examiner* — Andrew D Perreault

(74) *Attorney, Agent, or Firm* — Thompson Coburn LLP

(57) ABSTRACT

A stackable crate has a horizontally oriented bottom panel and four vertically oriented side panels that are separately attached at their edges to form the stackable crate. Two straight-line channels, with widths at their tops being greater than at their bottoms, form ribs within the crate. When the channels and ribs of a first crate are aligned with the channels of a second stackable crate, the first crate nests within the second crate even when non-uniform material in the second crate is stored within it, without spilling the material or toppling the stack. When the channels and ribs of the first crate are not aligned with the channels of the second crate, the first crate does not nest within the second crate but instead rests on the tops of the ribs of the first crate.

18 Claims, 6 Drawing Sheets

STACKABLE CRATE

CROSS-REFERENCE TO RELATED APPLICATIONS

This application claims the benefit of U.S. Provisional Application No. 63/190,263, filed on May 19, 2021. The entire disclosure of the above application is incorporated herein by reference.

FIELD

The present technology relates to a crate, and more particularly, to a crate configured to either stack or nest with another crate.

INTRODUCTION

This section provides background information related to the present disclosure which is not necessarily prior art.

Typically, a crate includes a horizontally oriented bottom panel having four side edges. In addition, the crate has four vertically oriented side panels that are separately attached at their bottom edges to one of the four side edges of the bottom panel. In turn, each of the four side panels are attached on their two vertical edges to respective vertical edges of the other panel side edges, thereby forming the crate.

Specifically, regarding a stackable milk crate, the four sides and bottom panels typically do not comprise a solid panel. Instead, all five panels comprise connected trestles forming openings therebetween, which are molded together to form the stackable crate. In addition, each crate is formed in a manner that allows one crate to be rested atop another, thereby allowing two or more milk crates to be stacked.

Material loaded within the stackable milk crates, which in modern settings does not necessarily involve milk bottles, is also not necessarily uniform in shape and size. Unfortunately, when stacking milk crates with non-uniform material stored therein, the crates also do not stack together in a uniform manner. Consequently, it is difficult to keep a stack of two or more crates from leaning or tipping over, thereby potentially spilling the contents out of the crate. Additionally, when milk crates are not filled and need to be stored, they may take up an undesirable amount of volume or storage space even when stacked.

There is a continuing need for stackable milk crates that can contain non-uniform material, while being stacked one-on-another in an orderly manner, so that non-uniform material does not cause the crate to lean or spill out of the milk crates or causes a stack thereof to topple. Desirably, the stackable milk crates may also be nested in a compact form for storage when they are not filled.

SUMMARY

In concordance with the instant disclosure, stackable crates that can contain non-uniform material, while being stacked one-on-another in an orderly manner, so that non-uniform material does not cause the crate or crates to lean or spill out therefrom or cause a stack thereof to topple, and which may also be nested in a compact form for storage when the crates are not filled, are surprisingly discovered.

In certain embodiments, a crate is provided that includes a sidewall. The sidewall can include a first complementary structure and a second complementary structure. The first complementary structure can include a first exterior channel and a first interior rib. The second complementary structure can include a second exterior channel and a second interior rib. The first interior rib can be configured to be received by the first exterior channel from another crate in a nested position. The first interior rib can be configured to be received by the second exterior channel from another crate in a stacked position. A length of the first interior rib received by the first exterior channel in the nested position can be greater than a length of the first interior rib received by the second exterior channel in the stacked position.

In certain embodiments, a crate is provided that includes an open end, a first sidewall portion, a second sidewall portion, a third sidewall portion, a fourth sidewall portion, and a bottom. The first sidewall portion can include two first complementary structures, where each first complementary structure includes a first exterior channel and a first interior rib. Each first interior rib can be configured to be received by a respective first exterior channel from another crate in a nested position. The second sidewall portion can include two second complementary structures, where each secondary complementary structure can include a second exterior channel and a second interior rib. Each first interior rib can be configured to be received by a respective second exterior channel from another crate in a stacked position. The third sidewall portion can be configured as a mirror image of the first sidewall portion. The fourth sidewall portion can be configured as a mirror image of the second sidewall portion. A length of each first interior rib received by the respective first exterior channel in the nested position can be greater than a length of each first interior rib received by the respective second exterior channel in the stacked position.

In certain embodiments, a method of coupling two crates is provided. The method can include providing two crates as described herein. The two crates can be coupled according to one of the following: receiving a first interior rib of one crate by a first exterior channel from another crate to form a nested position, and receiving a first interior rib of one crate by a second exterior channel from another crate to form a stacked position.

In certain embodiments, a stackable crate includes a horizontally oriented bottom having four side edges. In addition, the stackable crate has four vertically oriented sidewall portions that are separately attached at their bottom edges to one of the four side edges of the bottom panel. In turn, each of the four sidewall portions are attached on their two vertical edges to respective vertical edges of the other sidewall portion side edges, and bottom side edges, thereby forming the stackable crate. The bottom and four sidewall portions comprise connected trestles forming openings therebetween, which are molded together to form the stackable crate.

Embodiments of the stackable crate can include the following various aspects. Two first exterior channels can be vertically molded from top to bottom inward from the exterior of only two opposite side sidewall portions of the stackable crate. These four exterior channels can be respectively located near opposite vertical side edges of each of the two opposite sidewall portions. Thereby, all four first exterior channels can have a corresponding first interior rib formed on the interior of the stackable crate. Each first exterior channel can be formed in a manner, whereby its width at its bottom is greater than its width at its top. In other words, each of the first exterior channels can taper in width from the bottom to the top of the first exterior channel.

Embodiments of the stackable crate, consequently, can be nested into a second stackable crate if the orientation of the four first exterior channels of the first stackable crate are in line with the corresponding four first interior ribs of a second stackable crate. Thereby, stackable crates with this in line alignment, while containing non-uniform material, can be stacked one-on-another in an orderly manner. Further, with this in line alignment, the non-uniform material will not spill out of the stackable crates or cause the crate to lean or cause a stack thereof to topple.

On the other hand, when it is attempted to lower a first stackable crate into a second stackable crate, in an orientation where the four first exterior channels of each stackable crate are not in line with each other, the first stackable crate will not nest within the second stackable crate. Instead, the bottom of the first stackable crate can come to rest on a top edge of each of the four second exterior stackable crate channels. With this non-alignment orientation, if the second stackable crate has a handle molded on its top, the handle could help to prevent the first stackable crate from sliding off of its bottom.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

DETAILED DESCRIPTION

Figure 1:
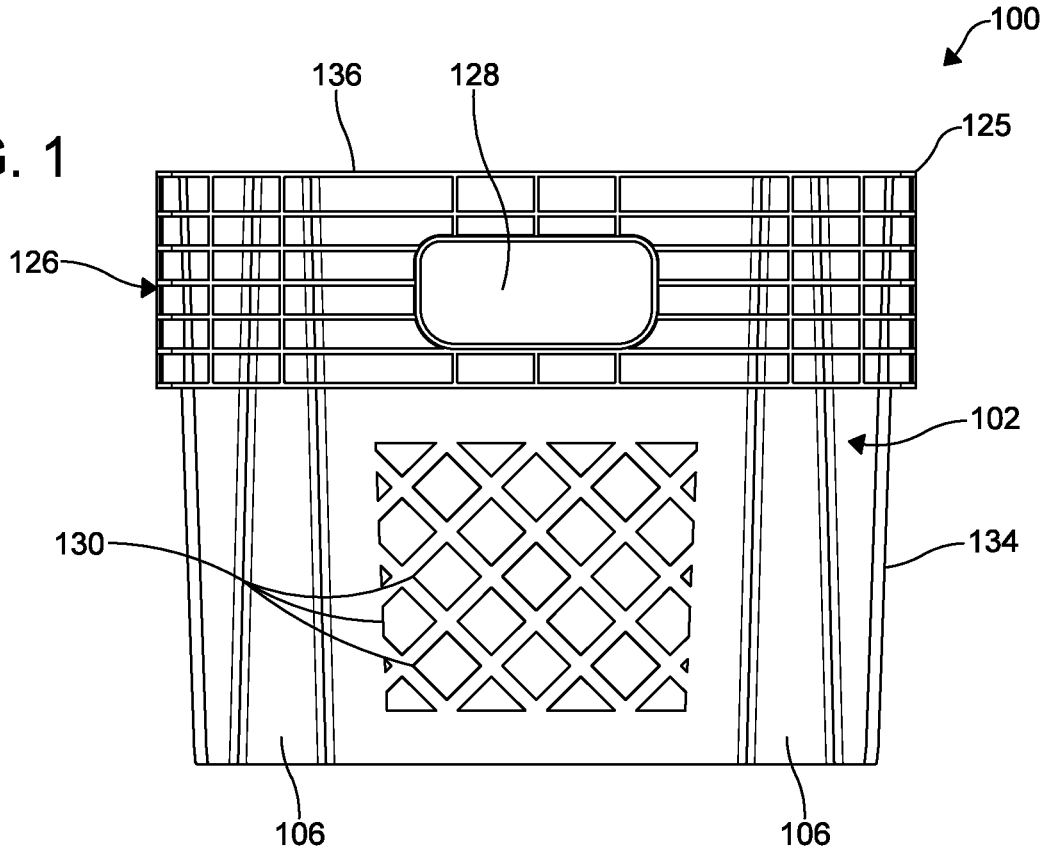
FIG. 1 is a side elevational view of an embodiment of a stackable crate in accordance with the present disclosure.

The following description of technology is merely exemplary in nature of the subject matter, manufacture and use of one or more inventions, and is not intended to limit the scope, application, or uses of any specific invention claimed in this application or in such other applications as may be filed claiming priority to this application, or patents issuing therefrom. Regarding methods disclosed, the order of the steps presented is exemplary in nature, and thus, the order of the steps can be different in various embodiments, including where certain steps can be simultaneously performed, unless expressly stated otherwise. "A" and "an" as used herein indicate "at least one" of the item is present; a plurality of such items may be present, when possible. Except where otherwise expressly indicated, all numerical quantities in this description are to be understood as modified by the word "about" and all geometric and spatial descriptors are to be understood as modified by the word "substantially" in describing the broadest scope of the technology. "About" when applied to numerical values indicates that the calculation or the measurement allows some slight imprecision in the value (with some approach to exactness in the value; approximately or reasonably close to the value; nearly). If, for some reason, the imprecision provided by "about" and/or "substantially" is not otherwise understood in the art with this ordinary meaning, then "about" and/or "substantially" as used herein indicates at least variations that may arise from ordinary methods of measuring or using such parameters.

Although the open-ended term "comprising," as a synonym of non-restrictive terms such as including, containing, or having, is used herein to describe and claim embodiments of the present technology, embodiments may alternatively be described using more limiting terms such as "consisting of" or "consisting essentially of." Thus, for any given embodiment reciting materials, components, or process steps, the present technology also specifically includes embodiments consisting of, or consisting essentially of, such materials, components, or process steps excluding additional materials, components or processes (for consisting of) and excluding additional materials, components or processes affecting the significant properties of the embodiment (for consisting essentially of), even though such additional materials, components or processes are not explicitly recited in this application. For example, recitation of a composition or process reciting elements A, B and C specifically envisions embodiments consisting of, and consisting essentially of, A, B and C, excluding an element D that may be recited in the art, even though element D is not explicitly described as being excluded herein.

As referred to herein, disclosures of ranges are, unless specified otherwise, inclusive of endpoints and include all distinct values and further divided ranges within the entire range. Thus, for example, a range of "from A to B" or "from about A to about B" is inclusive of A and of B. Disclosure of values and ranges of values for specific parameters (such as amounts, weight percentages, etc.) are not exclusive of other values and ranges of values useful herein. It is envisioned that two or more specific exemplified values for a given parameter may define endpoints for a range of values that may be claimed for the parameter. For example, if Parameter X is exemplified herein to have value A and also exemplified to have value Z, it is envisioned that Parameter X may have a range of values from about A to about Z. Similarly, it is envisioned that disclosure of two or more ranges of values for a parameter (whether such ranges are nested, overlapping or distinct) subsume all possible combination of ranges for the value that might be claimed using endpoints of the disclosed ranges. For example, if Parameter X is exemplified herein to have values in the range of 1-10, or 2-9, or 3-8, it is also envisioned that Parameter X may have other ranges of values including 1-9, 1-8, 1-3, 1-2, 2-10, 2-8, 2-3, 3-10, 3-9, and so on.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to" or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

In accordance with the present technology, a stackable crate 100 with complementary structures that provide additional stability when the stackable crate 100 is nested or stacked with another stackable crate 100', is shown in FIGS. 1-10.

Figure 2:
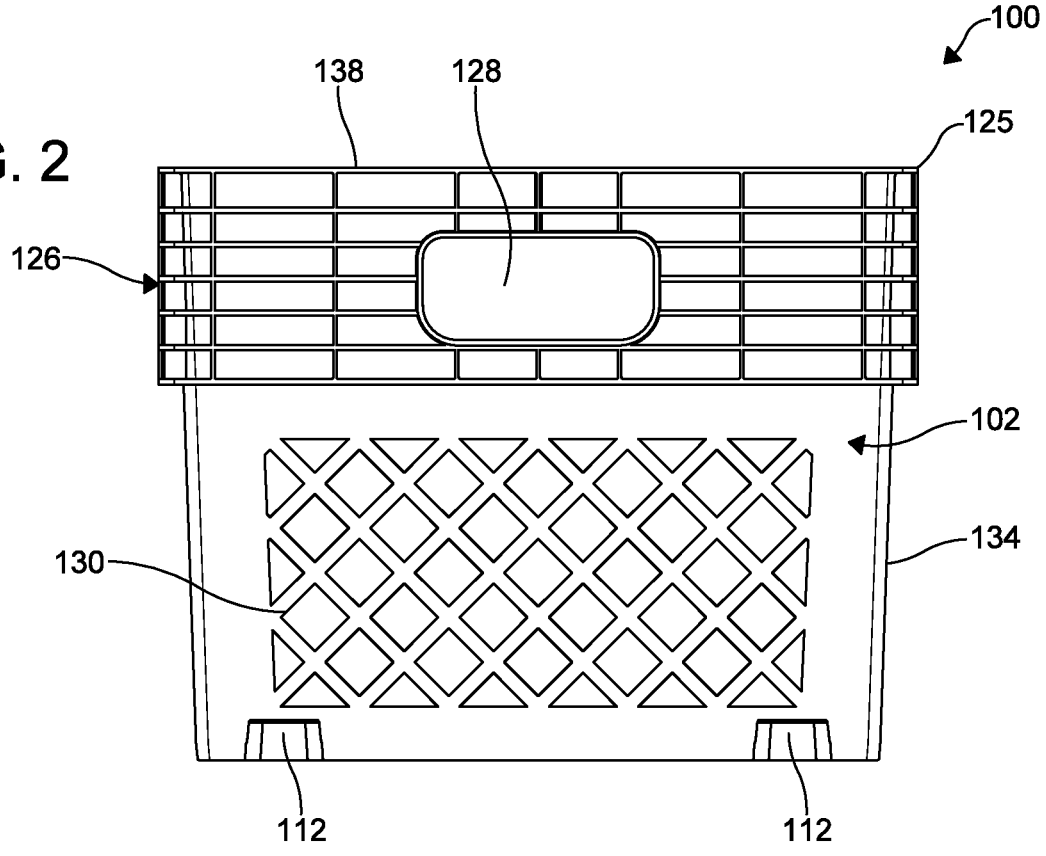
FIG. 2 is another side elevational view of the stackable crate.

A side elevational view of the stackable crate 100 and another side elevational view of the stackable crate 100 are shown in FIGS. 1-2, respectively. The stackable crate 100 includes a sidewall 102, which can include one or more tapered portions or where the entire sidewall 102 is tapered. In certain embodiments, the tapered sidewall 102 can have a draft of 2 degrees and other embodiments can have a draft of 3.5 degrees. This can allow the sidewall 102 to have a greater width at the top than the bottom.

Figure 3:
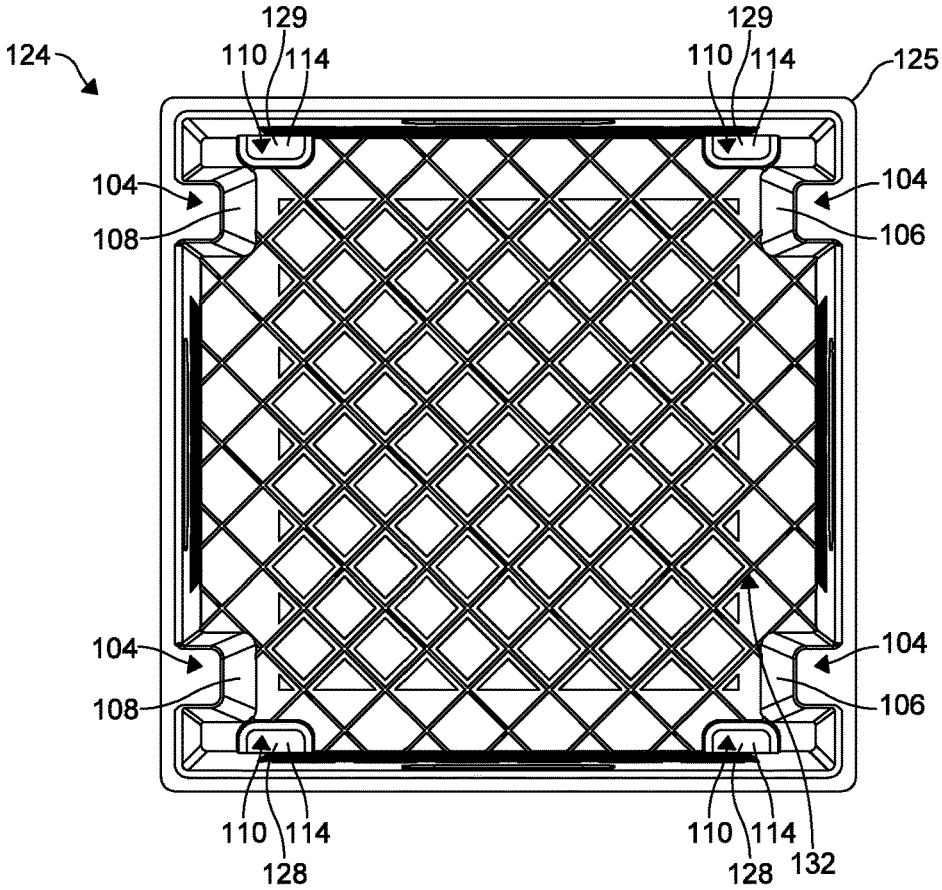
FIG. 3 is a top plan view of the stackable crate.
Figure 4:
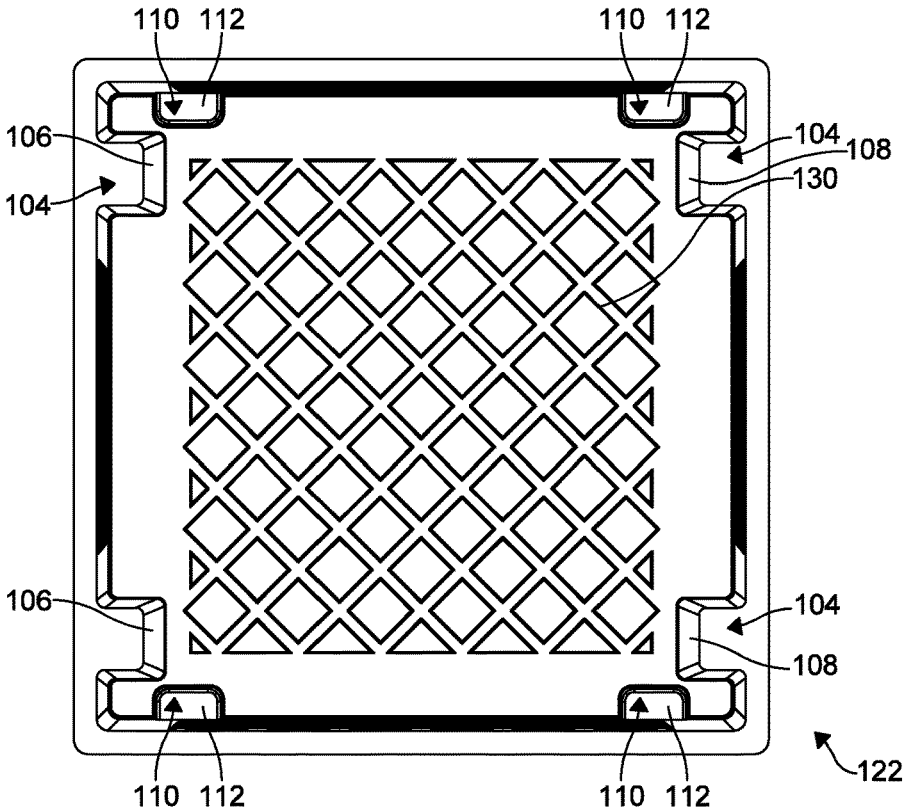
FIG. 4 is a bottom plan view of the stackable crate.
Figure 8:
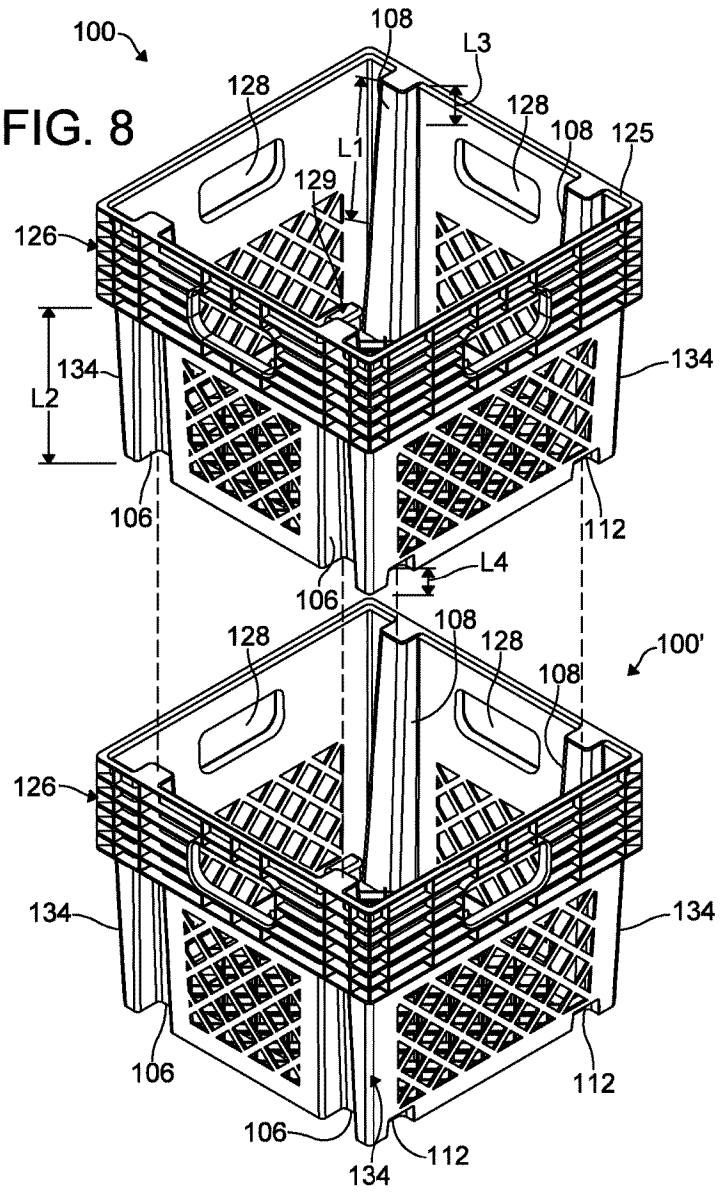
FIG. 8 is an exploded top perspective view of the stackable crate in the nested position with another stackable crate.
Figure 7:
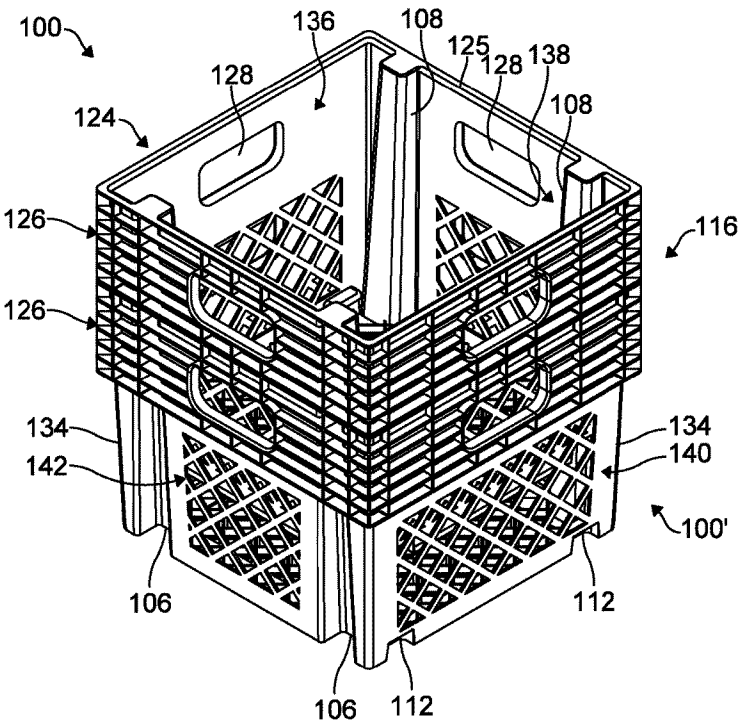
FIG. 7 is a top perspective view of the stackable crate in a nested position with another stackable crate.

With reference to FIGS. 3-4, aspects of the sidewall 102 of the stackable crate 100 can include one or more first complementary structures 104 including a respective first exterior channel 106 and a respective first interior rib 108. The sidewall 102 of the stackable crate 100 can also include one or more second complementary structures 110 including a respective second exterior channel 112 and a respective second interior rib 114. Each respective first interior rib 108 of the stackable crate 100 can be configured to be received by one of the respective first exterior channels 106 from another stackable crate 100' in a nested position 116, as shown in FIGS. 7-8. The first interior rib 108 of the stackable crate 100 can also be configured to be received by the second exterior channel 112 from the another stackable crate 100' in a stacked position 118, as shown in FIGS. 9-10.

In certain embodiments, the sidewall 102 can be curved, molded, or formed out of a single structure or include a continuous sidewall 102 which allows the stackable crate 100 to have a generally conical or cylindrical shape. Cross-sections of the sidewall 102 in such embodiments can be circular or ovoid. In other embodiments, the sidewall 102 can contain multiple facets or substantially planar portions resulting in various cross-sectional shapes, including rectangular, square, pentagonal, hexagonal, or other polygonal cross-sections with straight or curved sides. Other embodiments can contain a multitude of facets that are of differing lengths and thicknesses, allowing the cross section to form a diverse array of shapes. For example, the sidewall 102 can have one or more curved surfaces and can have a circular cross-section, where the sidewall 102 can be generally cylindrical or conical (not shown). The sidewall 102 can also be formed in other shapes, including shapes having various polygonal cross-sections, with straight and/or tapered portions. In some embodiments, the sidewall 102 can be one continuous wall. As shown, the embodiment of the sidewall 102 of the stackable crate 100 depicted in FIGS. 1-10 includes four generally planar portions having a generally square cross-section, each portion being slightly tapered.

Figure 10:
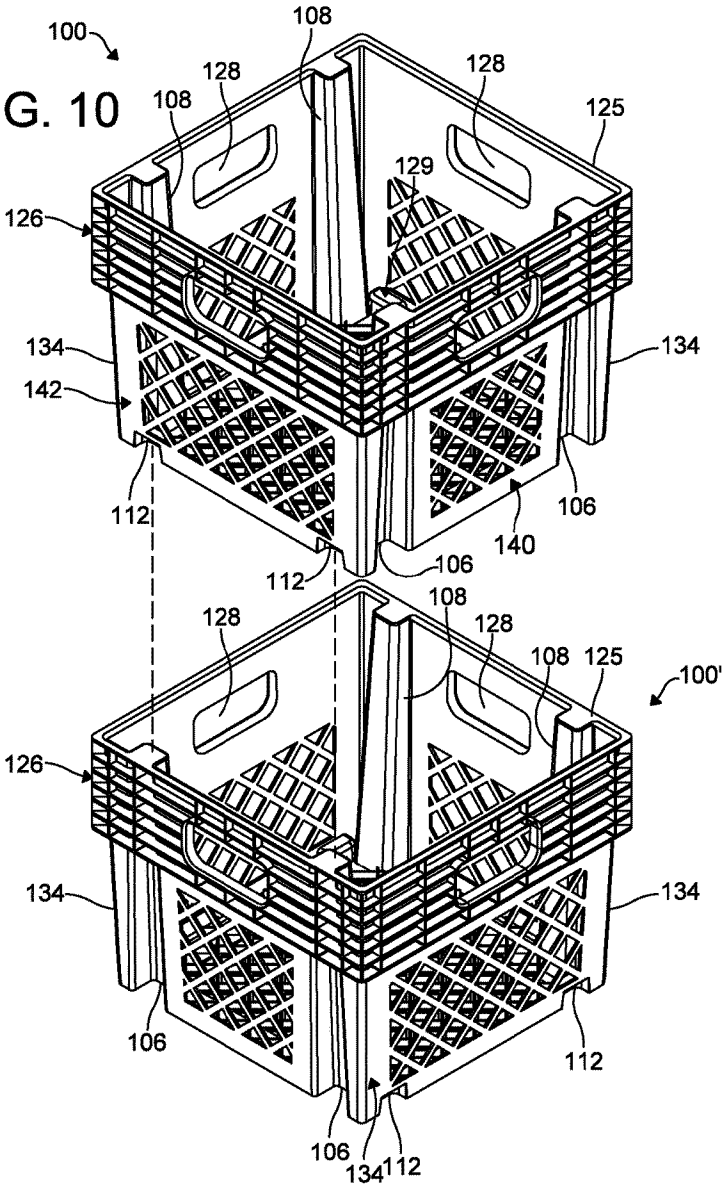
FIG. 10 is an exploded top perspective view of the stackable crate in the stacked position with another stackable crate.
Figure 9:
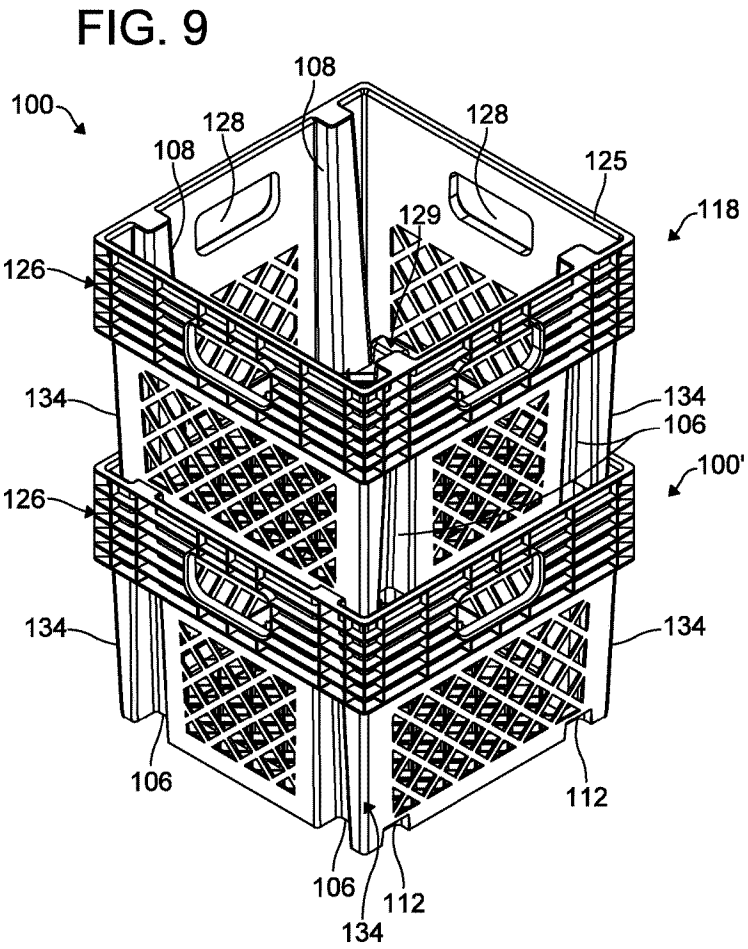
FIG. 9 is a top perspective view of the stackable crate in a stacked position with another stackable crate.

With reference to the nesting of the stackable crates 100, 100' shown in FIGS. 7-8 and the stacking of the stackable crates 100, 100' shown in FIGS. 9-10, a length of the first interior rib 108 of stackable crate 100' received by the first exterior channel 106 of stackable crate 100 in the nested position 116 can be greater than a length of the first interior rib 108 of stackable crate 100' received by the second exterior channel 112 of stackable crate 100 in the stacked position 118. Certain lengths (L1, L2, L3, and L4) are shown illustrated on stackable crate 100 in FIG. 8, where these lengths correspond to each of the respective first complementary structures 104 (and respective first exterior channel 106 and first interior rib 108) and each of the respective second complementary structures 110 (and respective second exterior channel 112 and second interior rib 114) for each stackable crate 100, 100'. As such, L1 corresponds to a length of the first interior rib 108 of stackable crate 100' received by the first exterior channel 106 of stackable crate 100. L2 corresponds to a length of the first exterior channel 106 of stackable crate 100 that receives the length of the first interior rib 108 of stackable crate 100'. L3 corresponds to a length of the first interior rib 108 of stackable crate 100' received by the second exterior channel 112 of stackable crate 100. And L4 corresponds to a length of the first exterior channel 106 of stackable crate 100 that receives the length of the first interior rib 108 of stackable crate 100'.

In the embodiment shown in FIGS. 1-10, L1 can equal L2 and L3 can equal L4. However, it should be noted that where one or more of the first complementary structures 104 and/or the second complementary structures 110 are not identical (e.g., have different tapers, shapes, or lengths), it is possible that L1 does not equal L2 and/or that L3 does not equal L4. It should also be recognized that L2 can represent the entirety of the length of the first exterior channel 106, which can be limited by a flange 126, and hence can determine the extent of L1. Likewise, L4 can represent the entirety of the length of the second exterior channel 112 and hence can determine the extent of L3. One skilled in the art can recognize that the nature of these certain lengths (L1, L2, L3, and L4) dictated by the cooperation of the first complementary structures 104 (and respective first exterior channel 106 and first interior rib 108) and the respective second complementary structures 110 (and respective second exterior channel 112 and second interior rib 114) can be tailored to adjust the extent of nesting of the stackable crates 100, 100' and the extent of stacking of the stackable crates 100, 100'.

With renewed reference to FIGS. 1-2, the stackable crate 100 can contain one or more portions of the sidewall 102 which are tapered toward a bottom 122 of the stackable crate 100. With reference to FIG. 7, a majority of the volume of stackable crate 100 can be received by the another stackable crate 100' when in the nested position 116. With reference to FIG. 9, the stackable crate 100' can also receive a minority of the volume of stackable crate 100 when in the stacked position 118.

With reference again to FIGS. 1-2 and 5-10, the stackable crate 100 can have an open end 124 adjacent to a top end 125 of the sidewall 102 which contains a flange 126 disposed around the open end 124. The flange 126 can limit the length L1 of the first interior rib 108 of another stackable crate 100' that the first exterior channel 106 of stackable crate 100 can receive in the nested position 116. For example, a stackable crate 100 with a larger flange 126 can create a larger volume of space between the bottom 122 of each crate 100 in the nested position 116. Alternatively, a crate 100 with a smaller flange 126 can allow a greater volume of the crate 100 to nest within another stackable crate 100' in the nested position 116, decreasing the volume of space between the bottom 122 of the stackable crate 100 and another stackable crate 100'.

Aspects of the stackable crate 100 can also include one or more handle openings 128 on one or more sides of the stackable crate 100, allowing the user to manipulate, carry, or pick up the stackable crate 100 by utilizing one or more handle openings 128. The handle openings 128 can be formed within the flange 126, for example. Certain embodiments can include a reinforced portion around one or more handle openings 128. This can be accomplished through increasing the thickness of one or more handle openings 128. In certain embodiments, increasing the area of the reinforced portion can provide a larger surface area for the user to grasp, carry, or manipulate the handle openings 128 of the stackable crate 100. In further embodiments, the handle openings 128 can take the form of various shapes or ridges to assist the user in grasping or manipulating the handle opening 128. In a further embodiment, the handle opening 128 can be located on the body of the sidewall 102 rather than the flange 126.

As shown in FIGS. 7-8, a bottom 122 of the stackable crate 100 can contact a top 129 of the second interior rib 114 of another stackable crate 100' in the nested position 116. Similarly, a bottom 122 of another stackable crate 100' can contact the top 129 of the second interior rib 114 of the stackable crate 100 in the nested position 116. FIGS. 9-10 show the top 129 of the second interior rib 114 of the stackable crate 100 in the stacked position 118 which corresponds to the top 129 of the second interior rib 114 of another stackable crate 100'. In some embodiments, neither the top 129 of the second interior rib 114 of the stackable crate 100 nor the top 129 of the second interior rib 114 of another stackable crate 100' engage any components or portions of the stackable crate 100 of another stackable crate 100' in the stacked position 118. In other embodiments, the flange 126 of the stackable crate 100 can prevent the bottom 122 of the stackable crate 100 from contacting the top 129 of the second interior rib 114 of another stackable crate 100'.

In the nested position 116, the flange 126 of the stackable crate 100 can rest on the top end 125 of the sidewall 102 of another stackable crate 100', limiting the length L1 of the first interior rib 108 of the stackable crate 100 that is received by a first exterior channel 106 of another stackable crate 100'. In other embodiments, the stackable crate 100 does not contain a flange 126, allowing the stackable crate 100 to nest into another stackable crate 100' and maximizing the length L1 of the first interior rib 108 of the stackable crate 100 that is received by a first exterior channel 106 of another stackable crate 100'. This can allow the stackable crate 100 to minimize the volume between the stackable crate 100 and another stackable crate 100' when they are in the nested position 116. This embodiment can allow the length L1 to closely correspond to the length 120 of the first interior rib 108. This can further allow the bottom of the second exterior channel 112 of the stackable crate 100 to contact the top 129 of the second interior rib 114 of another stackable crate 100'.

In certain embodiments, the stackable crate 100 can have a first exterior channel 106 and first interior rib 108 which taper towards the open end 124 of the stackable crate 100. This can allow the first complementary structure 104 of the stackable crate 100 to accommodate a corresponding complementary structure 104 of another stackable crate 100', allowing the stackable crate 100 to nest into another stackable crate 100', even when the channel tapers are inverted.

In some embodiments, the sidewall 102 and/or the bottom 122 of the stackable crate 100 can include one or more apertures 130. In other embodiments, the top end 125 of the sidewall 102 can include one or more apertures 130. The one or more apertures 130 can further include ribbing 132 which extends from the surface of the sidewall 102 and/or the bottom 122 of the stackable crate 100, where the ribbing 132 runs between one or more apertures 130. The ribbing 132 can also extend along the outside corners of the stackable crate 100. FIG. 3 is a top perspective view illustrating interior ribbing 132 on the bottom 122 of the stackable crate 100. However, it should be appreciated that the ribbing 132 can be placed on the exterior and/or interior surfaces of the sidewall 102 and/or the bottom 122 of the stackable crate 100.

The ribbing 132 can reinforce one or more apertures 130 to increase the structural integrity or sturdiness of the stackable crate 100. In a further embodiment, the ribbing 132 can serve to stabilize a stackable crate 100 and another stackable crate 100' in the nested position 116. Aspects of one or more apertures 130 can include squares, rectangles, circles, ovals, polygons, and a variety of other shapes. Some embodiments of the stackable crate 100 can have apertures 130 formed by trestles which form a lattice. The trestles can extend into the interior of the stackable crate 100 to form internal ribbing 132 which can allow the stackable crate 100 to provide additional stability for the contents of the stackable crate 100. In certain embodiments, the ribbing 132 can be formed to conform to receive shapes like squares, rectangles, etc. which correspond to specific items such as milk cartons, wine bottles, etc. In a further embodiment, the ribbing 132 can extend up to the flange 126 or to the top end 125 of the sidewall 102.

In certain embodiments, the first interior rib 108 or the second interior rib 114 can be shaped in a variety of different ways. Any number of designs could be used that allow the first interior rib 108 and the second interior rib 114 to mate with the first exterior channel 106 and second exterior channel 112.

In certain embodiments, the stackable crate 100 can have one or more first complementary structures 104. The stackable crate 100 can further include a one or more of the second complementary structures 110. Each respective first complementary structure 104 of the stackable crate 100 can be received by a corresponding first complementary structure 104 of another stackable crate 100' in the nested position 116. Each respective first complementary structure 104 of the stackable crate 100 can be configured to be received by a corresponding second complementary structure 110 of another stackable crate 100' in the stacked position 118. Changing the number of first complementary structures 104 and second complementary structures 110 can allow for numerous permutations of the stackable crate 100 and another stackable crate 100' which allow the stackable crate 100 and another stackable crate 100' to be configured in the nested position 116 and the stacked position 118.

With renewed reference to FIG. 8, the length L1 of the first interior rib 108 of another stackable crate 100' that can be received by the first exterior channel 106 of a stackable crate 100 in the nested position 116 can be greater than the length L3 of the first interior rib 108 of another stackable crate 100' received by the corresponding second exterior channel 112 of the stackable crate 100 in the stacked position 118. This can allow the stackable crate 100 and another stackable crate 100' to have a lesser combined height in the nested position 116 than the combined height of the same number of stackable crates 100 in the stacked position 118.

Aspects of the stackable crate 100 can include a sidewall 102 with one or more corners 134 formed by one or more sidewall 102 portions. As shown in FIGS. 3-4, corners 134 of the stackable crate 100 can form a 90 degree angle, allowing the cross section of the sidewall 102 of the stackable crate 100 to be rectangular or square. In other embodiments, the corners 134 of the stackable crate 100 can form angles ranging between 0 degrees and 360 degrees, allowing the stackable crate 100 to form a variety of shapes at different cross sections of the sidewall 102. In a further embodiment, the corners 134 of the sidewall 102 can also be rounded or curved.

Figure 6:
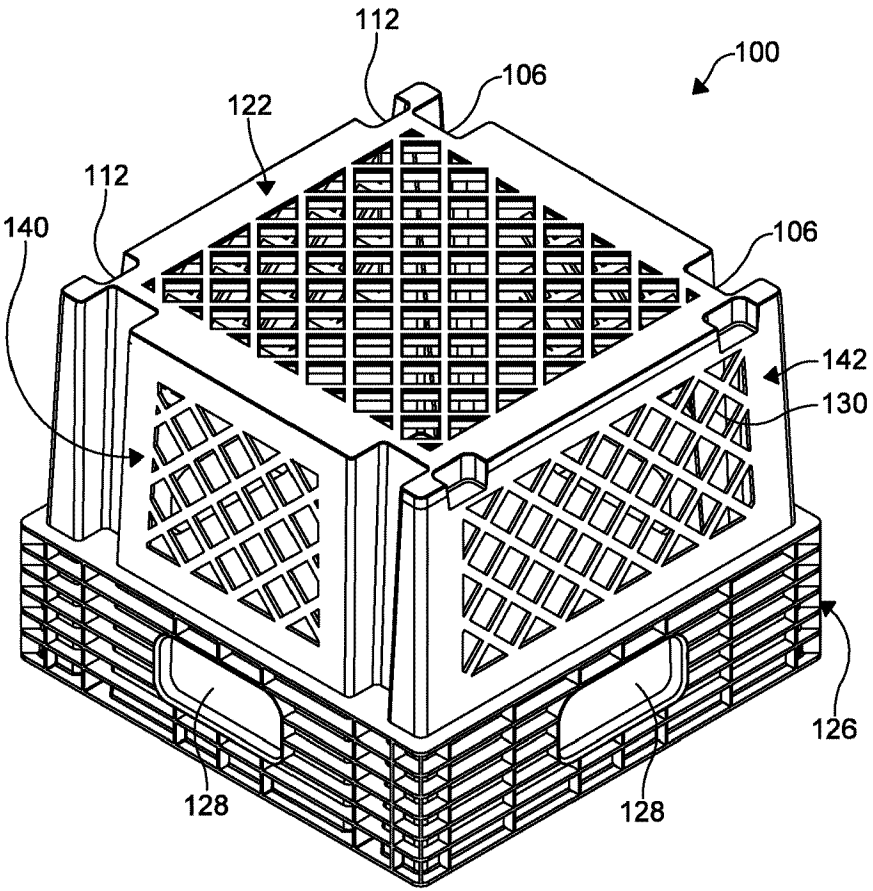
FIG. 6 is a bottom perspective view of the stackable crate.
Figure 5:
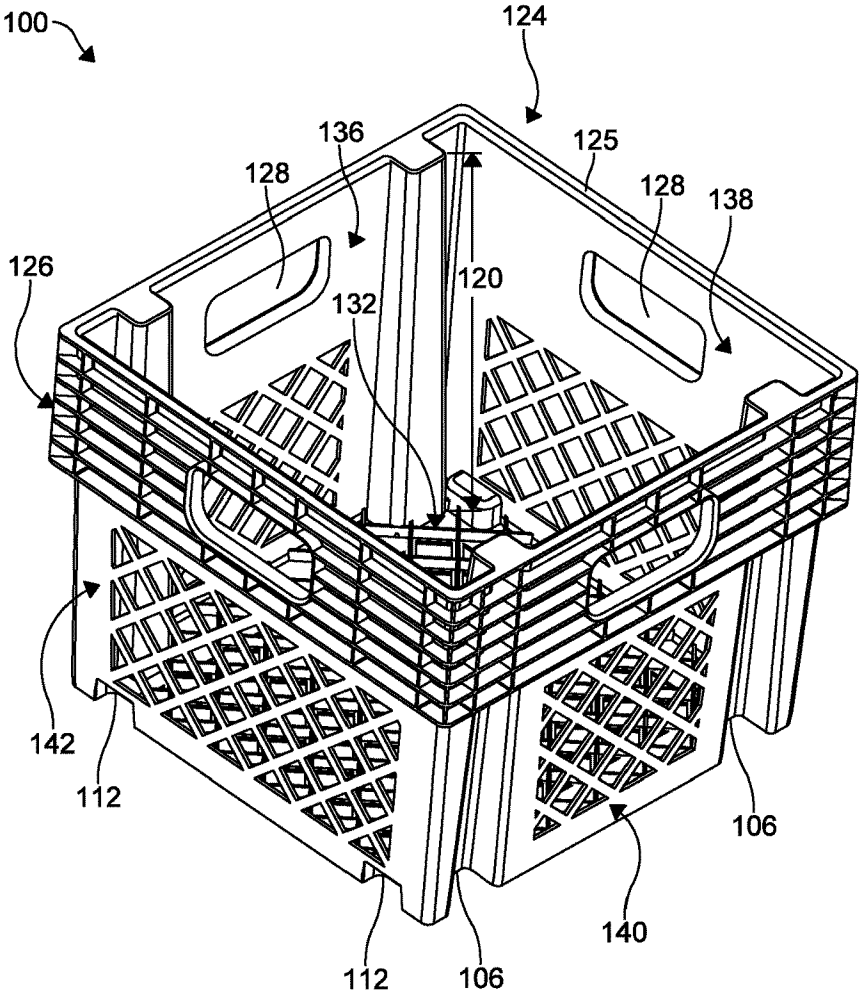
FIG. 5 is a top perspective view of the stackable crate.

With renewed reference to FIGS. 5-6, the stackable crate 100 can have a first sidewall portion 136, a second sidewall portion 138, a third sidewall portion 140, and a fourth sidewall portion 142 joined by corners 134. The stackable crate 100 can further include one or more first complementary structures 104 comprised by a first sidewall portion 136. Certain examples of the stackable crate 100 have first complementary structures 104 which are integrated with the first sidewall portion 136. In other examples, the first complementary structures 104 can form sections of the first sidewall portion 136. Similarly, the first complementary structures 104 can be integrated with or form sections of the second sidewall portion 138, third sidewall portion 140, and fourth sidewall portion 142.

In accordance with the instant disclosure, the stackable crate 100 and another stackable crate 100' are shown in FIGS. 5-10. With reference to FIG. 5, each of the stackable crate 100 and another stackable crate 100' include a horizontally oriented bottom 122 having a first sidewall portion 136, a second sidewall portion 138, a third sidewall portion 140, and a fourth sidewall portion 142. In addition, the stackable crate 100 and another stackable crate 100' have four vertically oriented sidewall portions, namely first sidewall portion 136, second sidewall portion 138, third sidewall portion 140, and fourth sidewall portion 142. Each sidewall portion is separately attached at their bottom edges to one of the four side edges of the bottom 122. In turn, each of the four side sidewall portions—first sidewall portion 136, second sidewall portion 138, third sidewall portion 140, and fourth sidewall portion 142—are attached on their two vertical edges to respective vertical side edges of the other sidewall portions. For example, the vertical side edge of the first sidewall portion 136 is attached to the vertical side edge of the second sidewall portion 138; the other vertical side edge of the second sidewall portion 138 is attached to the vertical side edge of the third sidewall portion 140; the other vertical side edge of the third sidewall portion 140 is attached to the vertical side edge of the fourth sidewall portion 142; and the other vertical side edge of the fourth sidewall portion 142 is attached to a first sidewall portion 136 thereby forming the stackable crate 100 or another stackable crate 100'. First sidewall portion 136, second sidewall portion 138, third sidewall portion 140, and fourth sidewall portion 142 and bottom 122 can comprise connected trestles forming one or more apertures 130 therebetween, which are molded together to form the stackable crate 100 or another stackable crate 100'.

As seen in FIGS. 1 and 5-10, the above described stackable crate 100 can have two first exterior channels 106 on each of the opposites sides of the stackable crate 100 which are vertically molded from top to bottom inward from the exterior of only two opposite sidewall portions, e.g. first sidewall portion 136 and third sidewall portion 140 or second sidewall portion 138 and fourth sidewall portion 142. These four first exterior channels 106 of the stackable crate 100 are respectively located near a vertical side edge of each of the two opposite sidewall portions—first sidewall portion 136 and third sidewall portion 140 or second sidewall portion 138 and fourth sidewall portion 142. All four first exterior channels 106 of the stackable crate 100 can have corresponding first interior ribs 108 (see FIG. 4) formed on the interior of the stackable crate 100. Each of the first exterior channels 106 of the stackable crate 100 can be formed to have a width that is greater at the open end 124 than its width at the bottom 122, allowing corresponding first interior ribs 108 of another stackable crate 100' to nest within the stackable crate 100.

As illustrated by FIGS. 5-6, the first sidewall portion 136, second sidewall portion 138, third sidewall portion 140, and fourth sidewall portion 142 can be formed out of one molded piece of plastic which can be created through additive manufacturing or injection molding. In other embodiments, the first sidewall portion 136, second sidewall portion 138, third sidewall portion 140, and fourth sidewall portion 142 can be formed out of a variety of different materials ranging from plastics, metals, wood, elastomeric materials, etc. through various methods including casting, riveting, welding, etc. Each bottom 122 and first sidewall portion 136, second sidewall portion 138, third sidewall portion 140, and fourth sidewall portion 142 of the stackable crate 100 can contain a multitude of materials. Certain combinations of materials such as elastomers for the ribbing 132, corners 134 or the handle opening 128 can advantageously provide shock absorption along with ease of use. In other examples, a wood or metal façade can enhance the aesthetic appeal of the stackable crate 100 and/or improve the overall structural integrity of the stackable crate 100.

As seen in FIGS. 2-10, examples of the stackable crate 100 can have a plurality of the second complementary structures 110 on a second sidewall portion 138, unlike the first sidewall portion 136. The stackable crate 100 can have a first sidewall portion 136, the second sidewall portion 138, a mirror image 144 of the first sidewall portion 136, and a mirror image 146 of the second sidewall portion 138. Other examples can have one or more second complementary structures 110 on the first, third, and fourth sidewall portions 136, 140, 142. The sidewall portions 136, 138, 140, 142 can also have both first complementary structures 104 and second complementary structures 110.

Variations of the stackable crate 100 and another stackable crate 100' can utilize different configurations and numbers of both first complementary structures 104 and second complementary structures 110, to achieve similar nested positions 116 and stacked positions 118. For example, the first sidewall portion 136 of the stackable crate 100 can have two first complementary structures 104 of the stackable crate 100 on either side of the handle opening 128 and a second complementary structure 110 of the stackable crate 100 below the handle opening 128. The second complementary structure 110 of the stackable crate 100 can be disposed adjacent to the bottom 122 of the stackable crate 100 or disposed on the sidewall 102 of the stackable crate 100. The second sidewall portion 138 of the stackable crate 100 can have two second complementary structures 110 which correspond to the placement of the first complementary structures 104 of the stackable crate 100 on the first sidewall portion 136. The second sidewall portion 138 of the stackable crate 100 can further include a first complementary structure 104 which corresponds to the placement of the second complementary structure 110 of the stackable crate 100 on the first sidewall portion 136. The stackable crate 100 can be formed out of a bottom 122 of the stackable crate 100, the first sidewall portion 136 of the stackable crate 100, the second sidewall portion 138 of the stackable crate 100, a mirror image 144 of the first sidewall portion 136 of the stackable crate 100, and a mirror image 146 of the second sidewall portion 138 of the stackable crate 100. This begets a stackable crate 100 with two handle openings 128, six first complementary structures 104, and six second complementary structures 110. Further embodiments can increase the number of complementary structures 104, 110 to achieve a similar effect. Similarly, other embodiments can use asymmetric designs with non-mirroring sidewall 102 portions to allow the stackable crate 100 to achieve a nested position 116 and a stacked position 118 which only aligns in one orientation.

As discussed above, certain stackable crates 100 can have a pair of opposed handle openings 128 disposed on opposing sidewall 102 portions and not on other sidewall 102 portions. For example, a stackable crate 100 can have a pair of handle openings 128 disposed on the first sidewall portion 136 and the third sidewall portion 140, or a pair of handle openings 128 disposed on the second sidewall portion 138 and the fourth sidewall portion 142. Handle openings 128 on the opposite sidewall 102 portion of the stackable crate 100 can allow the user to manipulate the stackable crate 100 more easily.

Aspects of the stackable crate 100 can include an open end 124 and a first sidewall portion 136 including two first complementary structures 104. As illustrated in FIGS. 3-4, the first complementary structure 104 can include a first exterior channel 106 and a first interior rib 108 which is configured to be received by a respective first exterior channel 106 from another stackable crate 100 in a nested position 116. Aspects of the stackable crate 100 can further include a second sidewall portion 138 with two second complementary structures 110. Each second complementary structure 110 can include a second exterior channel 112 and a second interior rib 114. Each first interior rib 108 can be configured to be received by a respective second exterior channel 112 from another stackable crate 100' in a stacked position 118. The stackable crate 100 can further include a third sidewall portion 140 configured as a mirror image 144 of the first sidewall portion 136. Some embodiments of the crate can also include a fourth sidewall portion 142 configured as a mirror image 146 of the second sidewall portion 138. With reference to FIG. 8, a length L1 of each first interior rib 108 of another stackable crate 100' received by the respective first exterior channel 106 of the stackable crate 100 in the nested position 116 can be greater than a length L3 of each first interior rib 108 of another stackable crate 100' received by the respective second exterior channel 112 of the stackable crate 100 in the stacked position 118.

FIGS. 1-2 show an embodiment with the first sidewall portion 136, the second sidewall portion 138, the third sidewall portion 140, and the fourth sidewall portion 142 which taper toward the bottom 122 of the stackable crate 100. This allows stackable crate 100' to receive a majority of a volume of another stackable crate 100 within the stackable crate 100 in the nested position 116 as seen in FIG. 7. This can also allow a minority of the volume of stackable crate 100 to be received within the stackable crate 100' in the stacked position 118 as seen in FIG. 9 when the stackable crate 100 and another stackable crate 100' are rotated orthogonally relative to each other in the stacked position 118.

Certain embodiments of the stackable crate 100 can be coupled with another stackable crate 100' as seen in FIGS. 7-10. The stackable crate 100 and another stackable crate 100' can each include a sidewall 102 which can include a first complementary structure 104 which includes a first exterior channel 106 and a first interior rib 108. The stackable crate 100 and another stackable crate 100' can include a second complementary structure 110 which can include a second exterior channel 112 and a second interior rib 114. Some embodiments can allow the first interior rib 108 of the stackable crate 100 to be configured to be received by the first exterior channel 106 from another stackable crate 100' in a nested position 116. The first interior rib 108 of the stackable crate 100 can be configured to be received by the second exterior channel 112 from another stackable crate 100' in a stacked position 118. In other embodiments, a length L1 of the first interior rib 108 of the stackable crate 100 can be received by the first exterior channel 106 of another stackable crate 100' in the nested position 116 as illustrated by FIG. 8. This length L1 of the first interior rib 108 of the stackable crate 100 can be greater than a length L3 of the first interior rib 108 of the stackable crate 100 received by the second exterior channel 112 of another stackable crate 100' in the stacked position 118. The first complementary structure 104 allows a first stackable crate 100 to be nested into a another stackable crate 100' if the orientation of the four first exterior channels 106 of a first stackable crate 100 are in line with the corresponding four first interior ribs 108 of a second stackable crate 100'.

Figure 11:
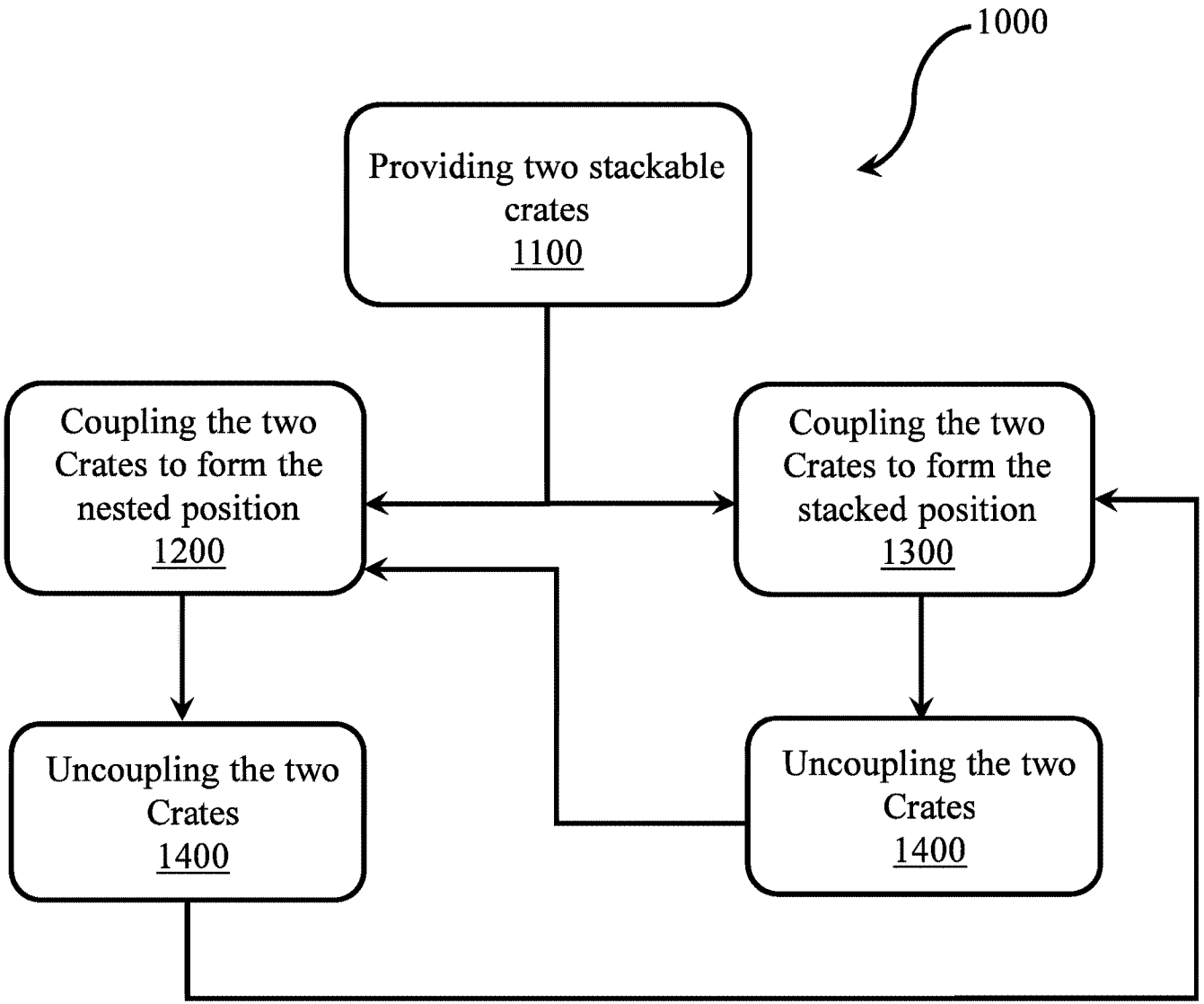
FIG. 11 is a flowchart of an embodiment of a method for coupling and uncoupling stackable crates.

With renewed reference to FIGS. 7-11, the user can couple the stackable crate 100 and another stackable crate 100' into one of the following configurations. FIG. 11 illustrates a flow diagram of an example of a method 1000 of coupling and uncoupling the stackable crate 100 and another stackable crate 100'. An example of the method includes but is not limited to the following steps. Providing the stackable crate 100 and another stackable crate 100' according to step 1100. Coupling the stackable crate 100 and another crate 100' according to method 1200 by receiving the first interior rib 108 of the stackable crate 100 into the second exterior channel 112 from another stackable crate 100' to form the stacked position 118 or coupling the stackable crate 100 and another crate 100' according to method 1300 by allowing the first interior rib 108 of the stackable crate 100 to be received by the first exterior channel 106 from another stackable crate 100' to form the nested position 116. This can further include a method 1400 of uncoupling the stackable crate 100 and another stackable crate 100' and using method 1200 or 1300. FIG. 11 depicts a flowchart which allows the example method 1000 to couple the stackable crate 100 and another stackable crate 100' in the other configuration by: receiving the first interior rib 108 of the stackable crate 100 by the first exterior channel 106 from another stackable crate 100' to form the nested position 116; or receiving the first interior rib 108 of the stackable crate 100 by the second exterior channel 112 from another stackable crate 100' to form the stacked position 118.

Certain embodiments of the stackable crate 100 can have a generally cylindrical or conical (not shown) sidewall 102. A further embodiment without a second complementary structure 110 or embodiments where only a small length of the first interior rib 108 of the stackable crate 100 is received by the second exterior channel 112 of another stackable crate 100' can allow the user to quickly convert a series of stackable crates 100 from the stacked position 118 into the nested position 116. To accomplish this, the user can rotate the top stackable crate 100 to nest the top stackable crate 100 into another stackable crate 100' below and lock the first exterior channel 106 of the stackable crate 100 into the first interior rib 108 from another stackable crate 100'. This embodiment allows the user to rotate the first stackable crate 100 in a single direction or in alternating directions to continuously nest one or more another stackable crates 100', converting the one or more stackable crates 100 and one or more another stackable crates 100' in the stacked position 118 to the nested position 116.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms, and that neither should be construed to limit the scope of the disclosure. In some example embodiments, well-known processes, well-known device structures, and well-known technologies are not described in detail. Equivalent changes, modifications and variations of some embodiments, materials, compositions and methods can be made within the scope of the present technology, with substantially similar results.

What is claimed is:

1. A crate comprising:

a sidewall, wherein the entire-sidewall is tapered toward the bottom of the crate, the sidewall including:

a first complementary structure including a first exterior channel and a first interior rib;

a second structure including a second exterior channel;

the first interior rib configured to be received by the first exterior channel from another crate in a nested position;

the first interior rib configured to be received by the second exterior channel of said another crate in a stacked position;

a flange disposed adjacent to an open end of the crate and including a first reinforced handle opening, a second reinforced handle opening, a third reinforced handle opening, and a fourth reinforced handle opening, each reinforced handle opening disposed through the flange, the first reinforced handle opening and the second reinforced handle opening are positioned as a first pair of opposed handle openings, the third reinforced handle opening and the fourth reinforced handle opening are positioned as a second pair of opposed handle openings;

the crate being of a shape such that in a nested position of the crate with said another crate, the first interior rib of the crate is aligned with the first exterior channel of said another crate, and a first length of the first interior rib of the crate extends into the first exterior channel of said another crate;

the crate being of a shape such that in a stacked position of the crate with said another crate, the first interior rib of the crate is aligned with the second exterior channel of said another crate, a second length of the first interior rib of the crate extends into the second exterior channel of said another crate, and the bottom of the crate is above the first and second pairs of opposed handle openings of said another crate such that the first and second pairs of opposed handle openings of said another crate are unobstructed in the stacked position;

the second length being shorter than the first length, wherein each of the first exterior channel and the second exterior channel extend from a bottom of the crate and along only a portion of a length of the sidewall, wherein the flange limits the length of the first interior rib received by the first exterior channel in the nested position.

2. The crate of claim 1, wherein a majority of a volume of the another crate is received within the crate in the nested position.

3. The crate of claim 1, wherein a minority of the volume of the another crate is received within the crate in the stacked position.

4. The crate of claim 1, wherein the second structure includes a second interior rib, and a bottom of the another crate contacts a top of the second interior rib in the nested position.

5. The crate of claim 1, wherein the first exterior channel and the first interior rib are tapered toward an open end of the crate.

6. The crate of claim 1, wherein the second structure includes a second interior rib, and the second exterior channel and the second interior rib are tapered toward an open end of the crate.

7. The crate of claim 1, wherein the sidewall includes a plurality of apertures.

8. The crate of claim 1, wherein ribbing extends from a surface of the sidewall running between a plurality of apertures.

9. The crate of claim 1, further comprising:

a plurality of the first complementary structures, each of the first complementary structures including a respective first exterior channel and a respective first interior rib;

a plurality of the second structures, each of the second structures including a respective second exterior channel;

each respective first interior rib configured to be received by one of the respective first exterior channels of said another crate in the nested position;

each respective first interior rib configured to be received by one of the respective second exterior channels of said another crate in a stacked position;

the crate being of a shape such that in a nested position of the crate with said another crate, each respective first interior rib is aligned with one of the respective first exterior channels of said another crate, and a first length of each respective first interior rib of the crate extends into one of the respective first exterior channels of said another crate;

the crate being of a shape such that in a stacked position of the crate with said another crate, each respective first interior rib is aligned with one of the respective second exterior channels of said another crate, and a second length of each respective first interior rib of the crate extends into one of the respective second exterior channels of said another crate;

the second length being shorter than the first length, wherein each one of the first exterior channels and each one of the second exterior channels extend from the bottom of the crate and along only a portion of a length of the sidewall.

10. The crate of claim 9, wherein the sidewall is comprised by a plurality of sidewall portions joined by corners, and the plurality of the first complementary structures is comprised by a first sidewall portion.

11. The crate of claim 10, wherein the plurality of the second structures is comprised by a second sidewall portion, the second sidewall portion being different form the first sidewall portion.

12. The crate of claim 11, wherein the plurality of sidewall portions includes the first sidewall portion, the second sidewall portion, a mirror image of the first sidewall portion, and a mirror image of the second sidewall portion.

13. The crate of claim 1, wherein the entire sidewall is tapered toward the bottom of the crate with a draft between 2 degrees and 3.5 degrees.

14. A method of coupling two crates, comprising:

providing a first crate and a second crate, each crate having a sidewall, wherein the sidewall is tapered toward the bottom of the crate, the sidewall including:

a first complementary structure including a first exterior channel and a first interior rib;

a second structure including a second exterior channel;

the first interior rib configured to be received by the first exterior channel from the other crate in a nested position;

the first interior rib configured to be received by the second exterior channel from the other crate in a stacked position;

a flange disposed adjacent to an open end of the crate and including a first reinforced handle opening, a second reinforced handle opening, a third reinforced handle opening, and a fourth reinforced handle opening, each reinforced handle opening disposed through the flange, the first reinforced handle opening and the second reinforced handle opening are positioned as a first pair of opposed handle openings, the third reinforced handle opening and the fourth reinforced handle opening are positioned as a second pair of opposed handle openings;

aligning the first interior rib of the first crate with the first exterior channel of the second crate, and causing a first length of the first interior rib of the first crate to extend into the first exterior channel of the second crate, to thereby nest the first and second crates;

aligning the first interior rib of the first crate with the second exterior channel of the second crate, and causing a second length of the first interior rib of the first crate to extend into the second exterior channel of the second crate, the second length being shorter than the first length;

wherein when the first crate is placed in the stacked position in the second crate, the bottom of the first crate is above the first and second pairs of opposed handle openings of the second crate such that the first and second pairs of opposed handle openings of the second crate are unobstructed in the stacked position.

15. A crate comprising:

a sidewall, wherein the sidewall is tapered toward the bottom of the crate, the sidewall including:

a first complementary structure including a first exterior channel and a first interior rib;

a second structure including a second exterior channel;

a flange disposed adjacent to an open end of the crate and including a first reinforced handle opening, a second reinforced handle opening, a third reinforced handle opening, and a fourth reinforced handle opening, each reinforced handle opening disposed through the flange, the first reinforced handle opening and the second reinforced handle opening are positioned as a first pair of opposed handle openings, the third reinforced handle opening and the fourth reinforced handle opening are positioned as a second pair of opposed handle openings;

the crate being of a shape such that in a nested position of the crate with an identical second crate, the first interior rib of the crate is aligned with the first exterior channel of said identical second crate, and a first length of the first interior rib of the crate extends into the first exterior channel of said identical second crate;

the crate being of a shape such that in a stacked position of the crate with said identical second crate, the first interior rib of the crate is aligned with the second exterior channel of said identical second crate, a first second length of the first interior rib of the crate extends into the second exterior channel of said identical second crate, and the bottom of the crate is above the first and second pairs of opposed handle openings of said identical second crate such that the first and second pairs of opposed handle openings of said identical second crate are unobstructed in the stacked position;

the second length being shorter than the first length.

16. The crate of claim 15, wherein:

the sidewall comprises:

a first sidewall portion including two first complementary structures, each first complementary structure including a first exterior channel and a first interior rib, each first interior rib configured to be received by a respective first exterior channel from said identical second crate in a nested position;

a second sidewall portion including two second complementary structures, each second complementary structure including a second exterior channel and a second interior rib, each first interior rib configured to be received by a respective second exterior channel from the identical second crate in a stacked position;

a third sidewall portion configured as a mirror image of the first sidewall portion;

a fourth sidewall portion configured as a mirror image of the second sidewall portion; and a length of each first interior rib received by the respective first exterior channel of the identical second crate in the nested position being greater than a length of each first interior rib received by the respective second exterior channel of the identical second crate in the stacked position.

17. The crate of claim 16, wherein:

the first sidewall portion, the second sidewall portion, the third sidewall portion, and the fourth sidewall portion are each tapered toward the bottom of the crate;

a majority of a volume of the identical second crate is received within the crate in the nested position;

a minority of the volume of the identical second crate is received within the cate in the stacked position; and the crate and the identical second crate are rotated orthogonally relative to each other in the stacked position.

18. The crate of claim 15, wherein the entire sidewall is tapered toward the bottom of the crate with a draft between 2 degrees and 3.5 degrees.

* * * * *